US007931576B2

(12) United States Patent
Chagnon et al.

(10) Patent No.: US 7,931,576 B2
(45) Date of Patent: Apr. 26, 2011

(54) TABLE FOR A CHOPPER FOLDING DEVICE AND CORRESPONDING CHOPPER FOLDING DEVICE

(75) Inventors: Franck Chagnon, Saint Leu d'Esserent (FR); Philippe Herda, Nogent sur Oise (FR); Thierry Melon, Breuil le Vert (FR); Jérôme Peres, Montataire (FR); Eric Pierda, Saint Leu d'Esserent (FR); Jean-François Robert, Creil (FR); Mathieu Rossi, Briot (FR); Thierry Vauchelle, Maignelay Montigny (FR)

(73) Assignee: Goss International Montataire SA, Montataire (FR)

( * ) Notice: Subject to any disclaimer, the term of this patent is extended or adjusted under 35 U.S.C. 154(b) by 0 days.

(21) Appl. No.: 12/157,388

(22) Filed: Jun. 10, 2008

(65) Prior Publication Data

US 2008/0307940 A1 Dec. 18, 2008

(30) Foreign Application Priority Data

Jun. 12, 2007 (FR) ..... 07 55684

(51) Int. Cl.
*B31F 1/00* (2006.01)

(52) U.S. Cl. ..... 493/418; 493/450; 493/444

(58) Field of Classification Search ..... 493/418, 493/416, 450, 444, 424, 427, 434, 442
See application file for complete search history.

(56) References Cited

U.S. PATENT DOCUMENTS

| | | | | |
|---|---|---|---|---|
| 3,632,104 | A * | 1/1972 | Dufour | 493/444 |
| 3,926,425 | A * | 12/1975 | Pierce et al. | 493/444 |
| 4,419,088 | A * | 12/1983 | Nemec | 493/444 |
| 4,549,728 | A * | 10/1985 | Odeau | 270/46 |
| 4,863,152 | A * | 9/1989 | Milo | 270/47 |

FOREIGN PATENT DOCUMENTS

| | | |
|---|---|---|
| DE | 43 14 239 | * 11/1994 |
| DE | 102 51 189 | * 6/2003 |
| FR | 2 546 818 | * 12/1984 |

* cited by examiner

*Primary Examiner* — Sameh H. Tawfik
(74) *Attorney, Agent, or Firm* — Davidson, Davidson & Kappel, LLC

(57) ABSTRACT

This table for a chopper folding device comprises a surface (20) for application of products to be folded (17), the application surface (20) extending along an application plane (PA), a folding opening (22) suitable for the passage of the products to be folded (17), at least one first guide portion (28) disposed adjacent to the folding opening (22) and comprising a first guide surface (32) inclined with respect to application plane. The table (12) comprises guiding means suitable for urging the product to be folded towards the first guide surface (32) and a first main suction hole (36) which opens on the first guide surface (32).

16 Claims, 5 Drawing Sheets

TABLE FOR A CHOPPER FOLDING DEVICE AND CORRESPONDING CHOPPER FOLDING DEVICE

This application claims priority to French application FR 07 55684, filed on Jun. 12, 2007, the entire disclosure of which is incorporated by reference herein.

TECHNICAL FIELD

The present invention relates to a table for a chopper folding device, of the type comprising a surface for application of products to be folded, the application surface extending along an application plane, a folding opening suitable for the passage of the products to be folded, at least one first guide portion disposed adjacent to the folding opening and comprising a first guide surface inclined with respect to the application plane.

BACKGROUND TO THE INVENTION

Chopper folding devices used in printing presses are known in the art. Such a chopper folding device is for example known from the document FR-A-2 546 818. These chopper folding devices include a folding table provided with a longitudinal slot through which signatures or leaflets are pushed during the folding by means of a folding blade.

The folding table includes an application surface on which the signatures to be folded are applied. The application surface is provided with a plurality of suction holes which serve to hold the signature against the table.

It has been found that the known chopper folding device leads to folding defects, particularly on the outer edges of the signatures when the folding speed is considerable.

These defects appear predominantly, but not exclusively, when the gsm weight of the paper used for the signatures is low.

SUMMARY OF THE INVENTION

The object of the invention is to enhance the quality of folding of the signatures, particularly at high folding speeds and with a low gsm weight of the paper.

To that end, the invention relates to a table for a chopper folding device of the type indicated, wherein the table comprises guiding means which are suitable for urging the product to be folded towards the first guide surface and which are provided with a first main suction hole which opens on the first guide surface.

According to particular embodiments, the table according to the invention includes one or several of the following features:

the table comprises a second guide portion disposed adjacent to the folding opening and facing the first guide portion, this second guide portion comprising a second guide surface inclined with respect to application plane, and the table comprises a second main suction hole which opens on the second guide surface;

the table defines a front part and a rear part according to a direction of displacement of a product to be folded on the table, and the or each main suction hole is disposed in a front half of the associated guide portion;

the or each guide portion comprises an auxiliary suction hole, and this auxiliary suction hole is offset from the main suction hole;

the or each auxiliary suction hole has a length less than the length of the associated main suction hole;

the table comprises, for each main suction hole, a main air duct which opens in the associated main suction hole and an auxiliary air duct which opens in the associated auxiliary suction hole, and the locations of the mouths of the main and auxiliary air ducts are disposed at ends of the main and auxiliary suction holes which are directed towards one another;

the or each main suction hole or, as the case may be, each auxiliary suction hole is situated at a location of the associated guide surface having an inclination of less than 45° relative to the application surface;

the or each guide surface has a curved cross-section, particularly in the shape of an arc of a circle;

the application surface has two halves separated by a plane of separation, and the table has a first group of suction and application holes extending over a first zone of the application surface and a second group of suction and application holes extending over a second zone of the application surface, the second zone is disposed on the same half of the application surface as the first zone, and each group of application holes is provided with an individual suction connector;

each group of application holes includes a vacuum chamber in which the application holes of the associated group of holes open and in which the associated suction connector opens;

the first and the second zones are offset from one another in the longitudinal direction;

the first and the second zones are offset from one another in the transverse direction;

the table includes a vacuum device connected to one or each of the main and/or auxiliary suction holes; and an application vacuum device is connected to the holes of each of the groups of holes.

The invention further relates to a chopper folding device of the type comprising a chopper folding blade, two folding rollers, and a chopper folding table, wherein the chopper folding table is a table as defined above.

DESCRIPTION OF THE DRAWINGS

The present invention will be better understood by reading the following description, which is given solely by way of example and with reference to the appended drawings, in which:

FIG. 1 shows a chopper folding device according to the invention, designated by the general reference 2. The device 2 is shown schematically and in section.

DESCRIPTION OF PREFERRED EMBODIMENTS

Figure 1:
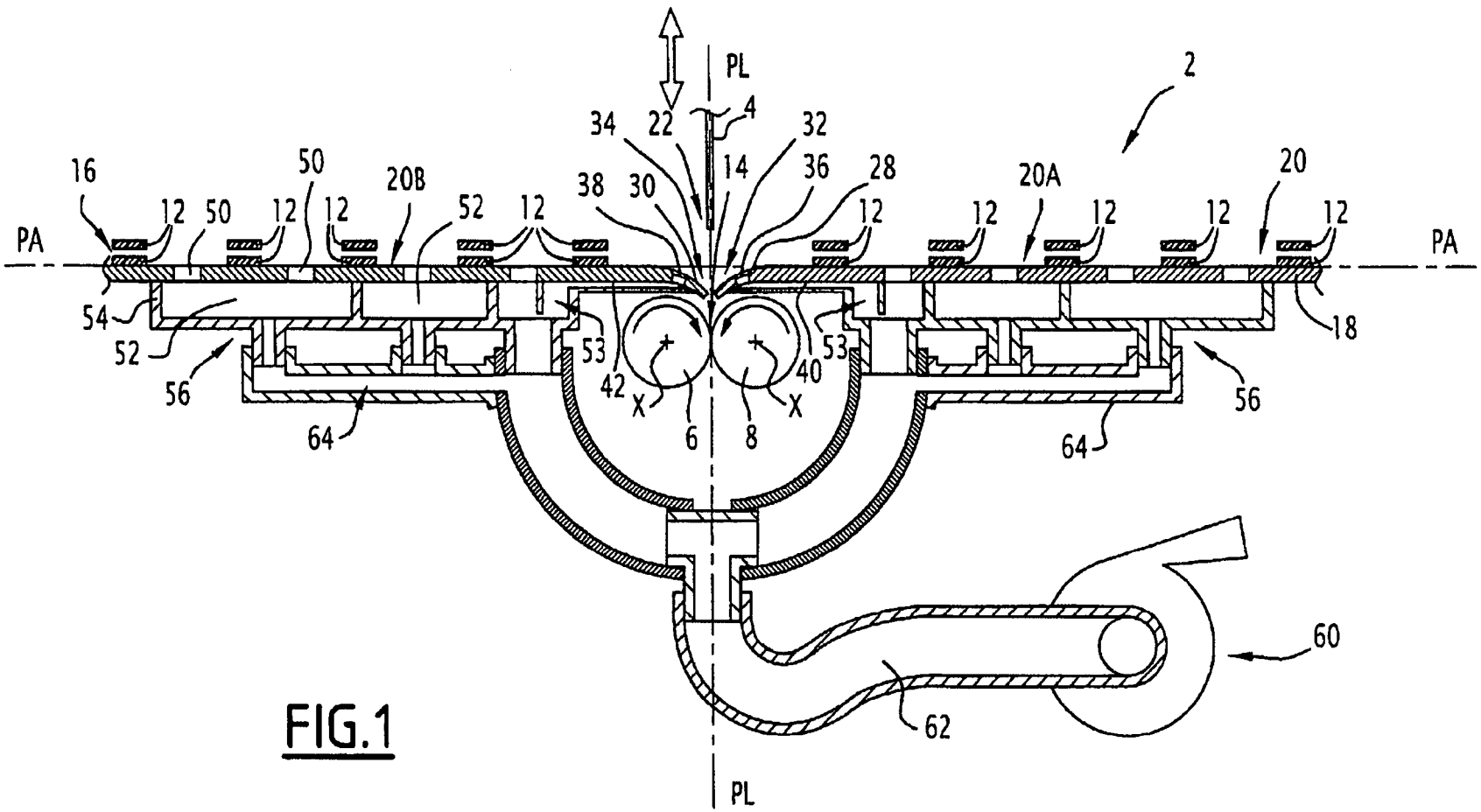
FIG. 1 is a schematic sectional view of a chopper folding device according to the invention.

The chopper folding device 2 bears a chopper folding blade 4, two folding rollers 6, 8 and a chopper folding table 10. The chopper folding device 2 also includes a plurality of conveyor belts 12.

The chopper folding blade 4 extends along a blade plane PL and it is movable along this blade plane PL alternately between a signature passing position and a signature folding position. FIG. 1 shows the folding position of the blade 4. The chopper folding blade 4 is driven between these two positions by a driving device (not shown).

The folding rollers 6, 8 are disposed so as to be movable in rotation about two respective axes X-X. The two axes X-X are parallel, such that the folding rollers 6, 8 define a signature folding gap 14 between them.

The conveyor belts 12 are disposed in two rows parallel alongside one another and the two rows define a transport gap 16 between them. The conveyor belts 12 guide signatures 17 to be folded into this gap 16 (see FIG. 2). The signatures 17 may be replaced by other products to be folded, such as leaflets or sheets. The paper of the products to be folded preferably has a weight between 40 g/m$^2$ and 130 g/m$^2$.

The signatures 17 are guided by the belts 12 in a conveying direction S. The conveyor belts 12 are suitable for guiding the signatures 17 to a folding position.

The chopper folding table 10 includes a base plate 18 provided with an application surface 20 on which the signatures 17 to be folded are applied. This application surface 20 defines an application plane PA extending perpendicular to the blade plane PL. The base plate 18 delimits a folding opening 22 extending parallel to the conveying direction S. The length of the folding opening 22, measured in the conveying direction S, is at least equal to the length of the signatures 17. The folding table 10 also defines a front part 24 and a rear part 26 according to the conveying direction S.

The application surface 20 is divided into two surface halves 20A, 20B which are separated by a plane of separation formed by the blade plane PL.

The chopper folding table 10 is also provided with a first guide portion 28 and a second guide portion 30. The guide portions 28, 30 are disposed adjacent to the folding opening 22 and delimit the latter. The first guide portion 28 includes a first guide surface 32, whilst the second guide portion 30 includes a second guide surface 34. Each of the guide surfaces 32, 34 is inclined with respect to the application plane PA. In this case each of the first 32 and second 34 guide surfaces has a curved cross-section, particularly in the shape of an arc of a circle.

The chopper folding table 10 includes guiding means suitable for urging the signature 17 during folding on the one hand towards the first guide surface 32 and on the other hand towards the second guide surface 34.

Figure 2:
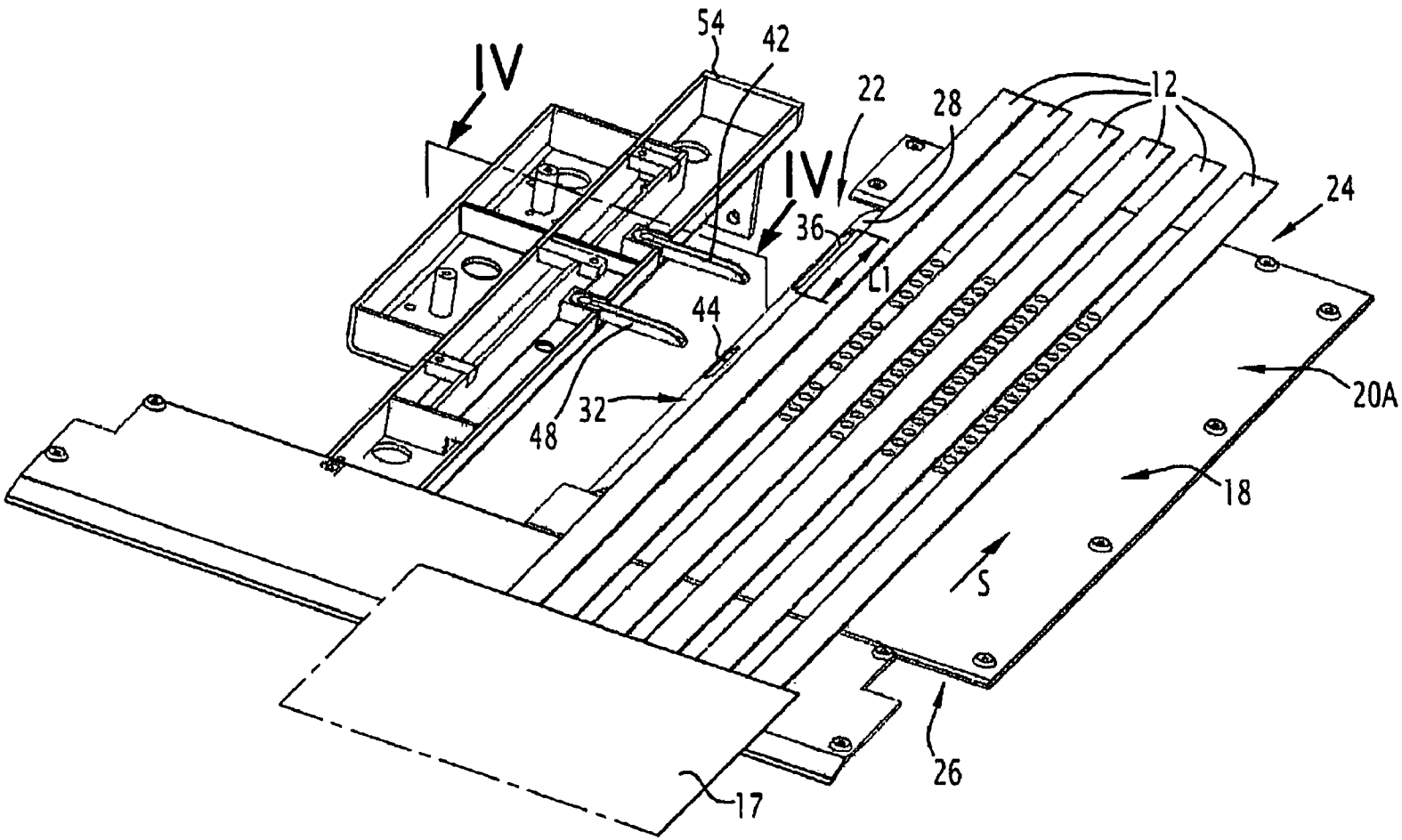
FIG. 2 is a perspective view of a part of a chopper folding table of the device of FIG. 1.
Figure 5:
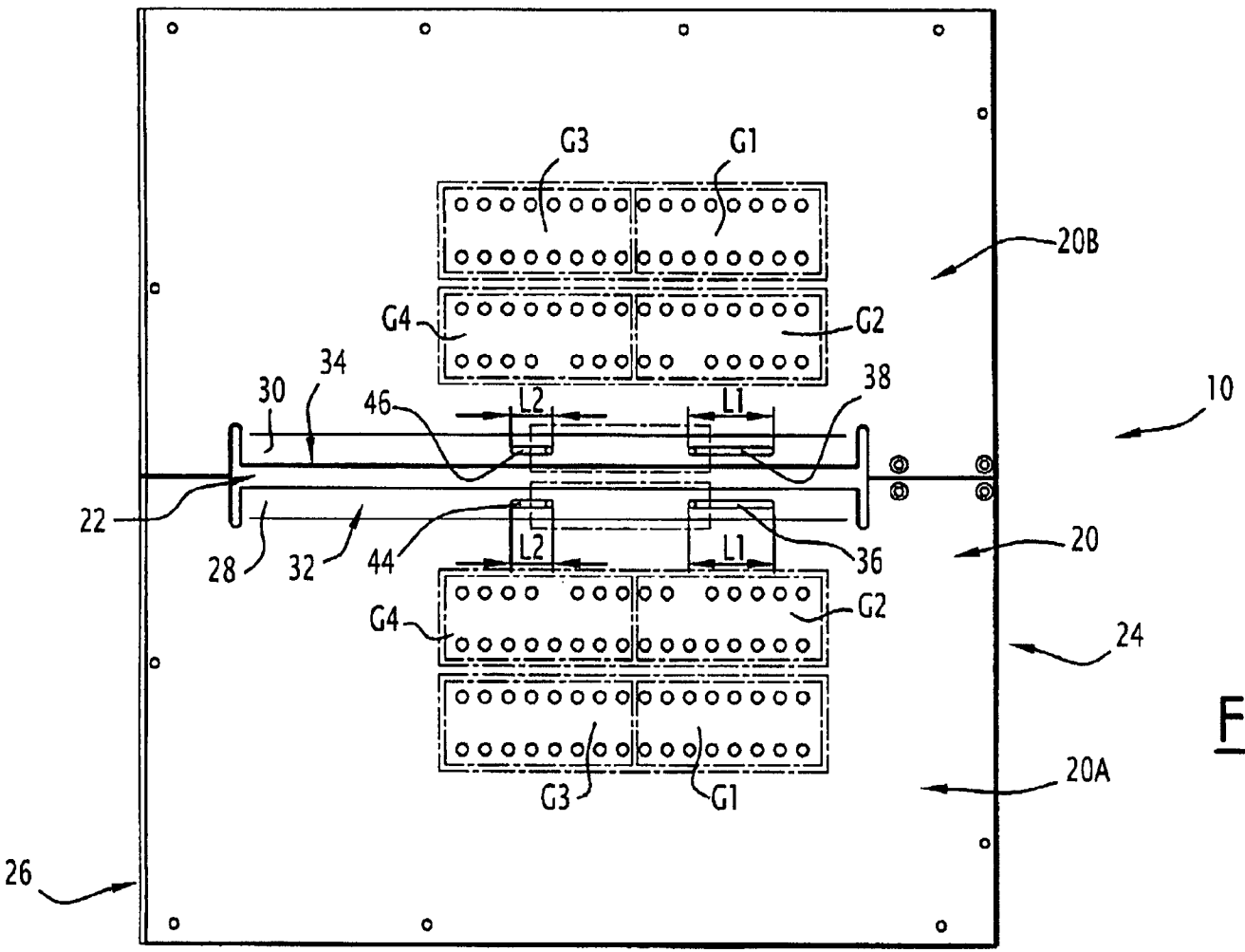
FIG. 5 is a plan view of the chopper folding table according to the invention.

To that end, the chopper folding table 10 includes a first main suction hole 36 (FIG. 2) which opens on the first guide surface 32 as well as a second main suction hole 38 (see FIG. 3) which opens on the second guide surface 34. Each main suction hole 36, 38 is an oblong cutout extending in the conveying direction S and having a given length L1 measured in the conveying direction S. As can be seen in FIGS. 2 and 5, the main suction holes 36, 38 are disposed exclusively in a front half of the associated guide portion 28, 30.

The chopper folding table 10 is also provided with a first main air duct 40 and a second main air duct 42 which opens in the associated main suction hole 36, 38.

The first guide portion 28 comprises a first auxiliary suction hole 44 and the second guide portion 30 includes a second auxiliary suction hole 46. Each auxiliary suction hole 44, 46 is offset, upstream in the conveying direction S, from the associated main suction hole 36, 38. In this case each auxiliary suction hole 44, 46 is disposed in an upstream half of the associated guide portion 28, 30.

Each auxiliary suction hole 44, 46 has a length L2 measured in the conveying direction S. This length L2 is less than the length L1. Due to this characteristic, the signature is better guided in a head zone than in the region of a tail zone. Moreover, since the length of the signature may vary from one series of signatures to another, the auxiliary suction holes 44, 46 are always entirely covered by a signature irrespective of its length.

Also the folding rollers 6, 8 may have grooves for local release of the signature. In this case the main holes 36, 38 and the auxiliary holes 44, 46 are aligned in the direction S with the local release grooves.

Figure 3:
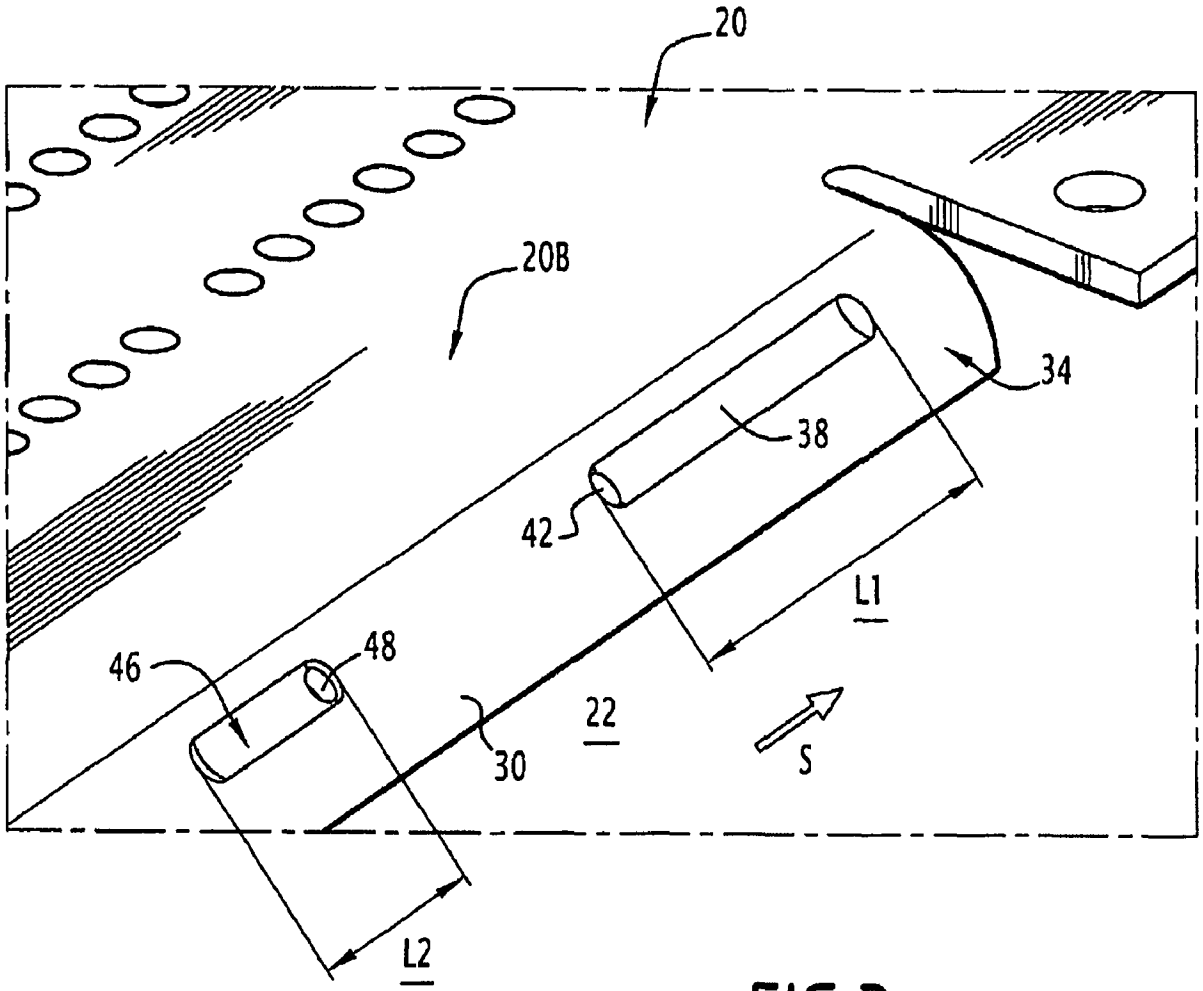
FIG. 3 is a perspective view of a detail on a larger scale of the table according to the invention.

The chopper folding table 10 also has two auxiliary air ducts 48, each of these ducts opening in the associated auxiliary suction hole 44, 46, as can be seen in FIG. 3. The locations of the mouths of the main air ducts 40, 42 and auxiliary air ducts 48 are disposed at ends of the main suction holes 36, 38 and auxiliary suction holes 44, 46 which are directed towards one another. This makes it possible to draw the signatures 17 by suction over a substantial axial length whilst maintaining a short length of the ducts.

The main suction holes 36, 38 and the auxiliary suction holes 44, 46 are disposed at locations of the associated guide portion 28, 30 having an inclination of less than 45° relative to the application surface 20.

Figure 4:
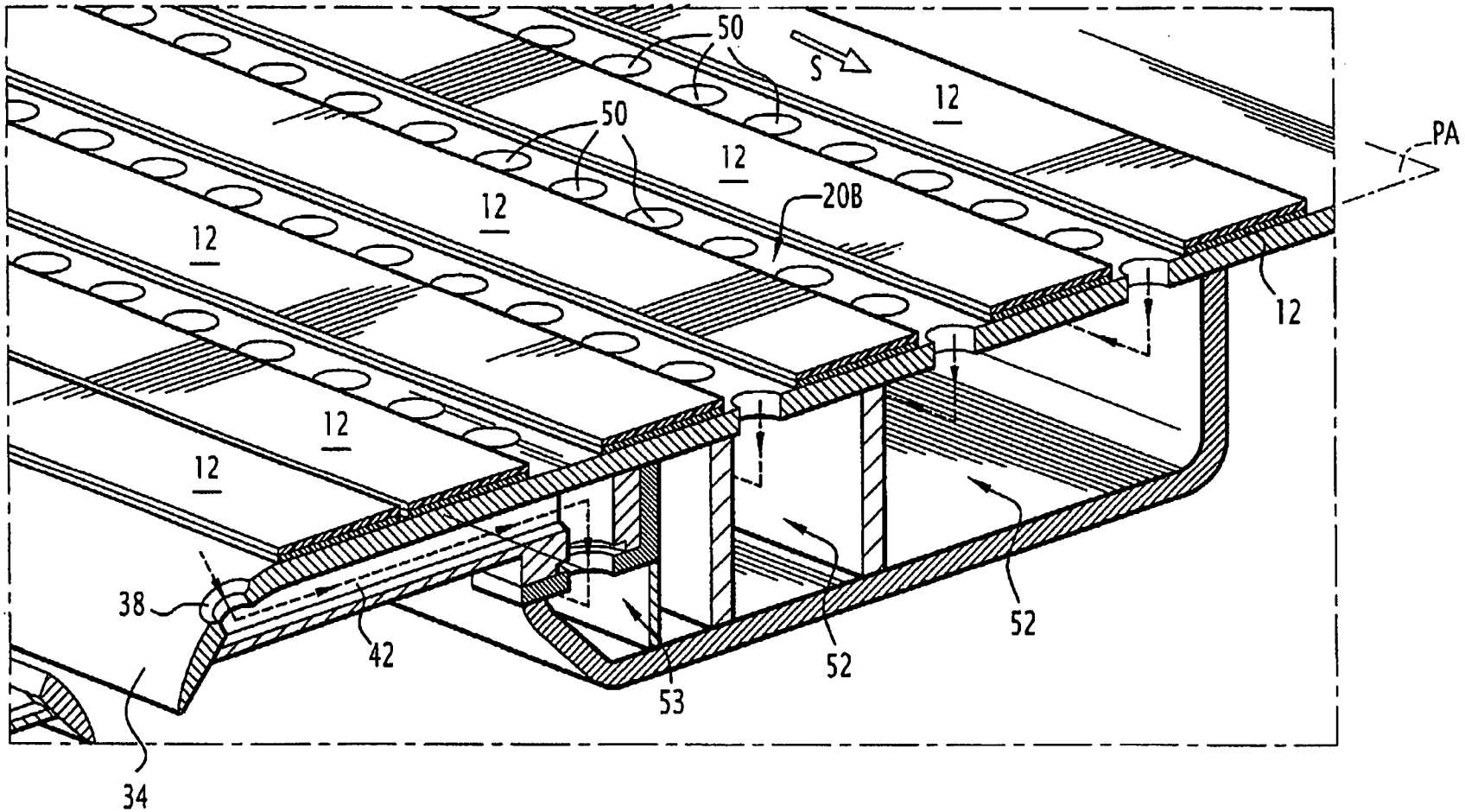
FIG. 4 is a perspective view, the table being sectioned according to the plane IV-IV of FIG. 2.

The chopper folding table 10 also has suction and application holes 50 which open on the application surface 20. The suction and application holes 50 are combined in a plurality of groups of holes G1, G2, G3, G4 which are illustrated in FIG. 5. Each of the groups of holes G1, G2, G3, G4 extends over a zone of the application surface 20. The zones defined by the groups G1 to G4 are disposed on the same half 20A or 20B of the application surface 20. Each suction and application hole 50 of a specific group of holes G1 to G4 opens into the same vacuum chamber 52 (see FIG. 4) delimited by a vacuum box 54. Thus the vacuum box 54 includes four vacuum chambers 52. As indicated in FIG. 5, each half 20A and 20B of the surface is provided with a group G1 to G4 of holes 50.

The vacuum box 54 also delimits a vacuum chamber 53 in which the main suction ducts 40, 42 and auxiliary suction ducts 48 open.

Each vacuum chamber 52 is provided with an individual suction connector 56 separate from the suction connector 56 of the other vacuum chambers 52. As can be seen in FIG. 5, the groups G1 and G2 are offset from the groups G3 and G4 in the direction of the length of the table, that is to say in the conveying direction S. The groups G2 and G4 are offset from the groups G1 and G3 in the direction of the width of the table, that is to say perpendicularly to the conveying direction S.

The chopper folding table 10 is also provided with a vacuum device (see FIG. 1), comprising a vacuum pump 60 connected to a manifold 62. The manifold 62 is connected by branching connectors 64 to each of the individual connectors 56 and to each of the air ducts 40, 42.

The device according to the invention functions in the following manner.

The signatures to be folded 17 are conveyed in the conveying direction S by the conveyor belts 12. As soon as the signature 17 covers the holes 50 it is urged against the application surface 20 of the base plate 18. Then the chopper folding blade 4 is brought into its folding position and pushes the central part of the signature 17 through the folding opening 22. The central part of the signature 17 is gripped by the folding rollers 6, 8 and is driven downwards. During this operation the central part of the signature 17 is held against the guide surfaces 32, 34. The signature 17 is held flat against the guide portions 28, 30 until side edges of the signature 17 clear the main holes 36, 38 and auxiliary holes 44, 46.

Therefore the side edges of the signature 17 are not released abruptly and therefore do not "whiplash" just before they pass between the rollers 6, 8.

It will be understood that due to the suction holes 36, 38, 44, 46 the folding rate can be high without causing damage to the signatures 17, even if these signatures 17 comprise paper of a low gsm weight.

The invention claimed is:

1. A table for a chopper folding device comprising:

a surface for application of products to be folded, the application surface extending along an application plane, the surface having a folding opening suitable for passing the products to be folded;

at least one first guide portion disposed adjacent to the folding opening and comprising a first guide surface inclined with respect to the application plane; and a guide suitable for urging the product to be folded towards the first guide surface and provided with a first main suction hole opening on the first guide surface.

2. The table according to claim 1 further comprising a second guide portion disposed adjacent to the folding opening and facing the first guide portion, the second guide portion comprising a second guide surface inclined with respect to the application plane; and a second main suction hole which opens on the second guide surface.

3. The table according to claim 1 wherein the table defines a front part and a rear part according to a direction of displacement of a product to be folded on the table, and that the first main suction hole is disposed in a front half of the associated guide portion.

4. The table according to claim 3 further comprising for the first main suction hole, a main air duct opening in the first main suction hole and an auxiliary air duct opening in the auxiliary suction hole, and that a location of the mouth of the main air duct and the auxiliary air duct are disposed at ends of the first main suction hole and auxiliary suction hole directed towards one another.

5. The table according to claim 1 wherein at least one first guide portion comprises an auxiliary suction hole, and that the auxiliary suction hole is offset from the first main suction hole.

6. The table according to claim 5 wherein the auxiliary suction hole has a length less than the length of the main first suction hole.

7. The table according to claim 1 wherein the first main suction hole is situated at a location of the first guide surface having an inclination of less than 45° relative to the application surface.

8. The table according to claim 1 wherein the first guide surface has a curved cross-section.

9. The table according to claim 8 wherein the curved cross section is in the shape of an arc of a circle.

10. The table according to claim 9 further comprising an application vacuum device connected to the holes of each of the groups of holes.

11. The table according to claim 1 wherein the application surface has two halves separated by a plane of separation, and that the table has a first group of suction and application holes extending over a first zone of the application surface and a second group of suction and application holes extending over a second zone of the application surface, that the second zone is disposed on the same half of the application surface as the first zone, and that each group of application holes is provided with an individual suction connector.

12. The table according to claim 11 wherein each group of application holes includes a vacuum chamber, the application holes of the associated group of holes opening into the vacuum chamber and the associated suction connector opening into the vacuum chamber.

13. The table according to claim 11 wherein the first zone and the second zone are offset from one another in the longitudinal direction.

14. The table according to claim 11 wherein the first zone and the second zone are offset from one another in the transverse direction.

15. The table according to claim 1 further comprising a vacuum device connected to the first main suction hole.

16. A chopper folding device comprising:

a chopper folding blade;

two folding rollers; and a chopper folding table as recited in claim 1.

* * * * *